United States Patent [19]

Lee et al.

[11] 4,278,929

[45] Jul. 14, 1981

[54] REGULATED NEGATIVE VOLTAGE SUPPLY

[75] Inventors: Robert D. Lee; Richard W. Ulmer, both of Austin, Tex.

[73] Assignee: Motorola, Inc., Schaumburg, Ill.

[21] Appl. No.: 96,274

[22] Filed: Nov. 21, 1979

[51] Int. Cl.[3] ..... G05F 1/40

[52] U.S. Cl. ..... 323/311

[58] Field of Search ..... 323/19, 22 R; 330/297

[56] References Cited

U.S. PATENT DOCUMENTS

| | | | |
|---|---|---|---|
| 3,639,824 | 2/1972 | Malavasi | 323/19 X |
| 3,826,969 | 7/1974 | Eichelberger et al. | 323/19 |
| 4,099,115 | 7/1978 | Watanabe | 323/19 |
| 4,110,677 | 8/1978 | Boronkay et al. | 323/19 |

*Primary Examiner*—William M. Shoop

*Attorney, Agent, or Firm*—Vincent B. Ingrassia

[57] ABSTRACT

A single chip MOS regulated negative power supply is comprised of first, second and third strings of field effect transistors and first and second amplifiers. The first string in conjunction with the zener diode develops a reference voltage which then passes through a voltage to current converter comprised of a first amplifier, the second string and an output transistor. The current thus produced passes through a third string of field effect transistors which is referenced to ground. The second amplifier provides negative feedback to the third string to produce the regulated output.

10 Claims, 2 Drawing Figures

REGULATED NEGATIVE VOLTAGE SUPPLY

BACKGROUND OF THE INVENTION

1. Field of the Invention

This invention relates generally to power supplies and, more particularly, to an MOS power supply for generating a regulated negative output.

2. Description of the Prior Art

Typically, to create a regulated negative supply from an unregulated source, one would use a zener diode and a unity gain buffer and employ a voltage divider at its input or output. The problem with such an arrangement is that the reference voltage generated $V_{REF}$ would be proportional to $V_{DD}-V_Z$ where $V_Z$ is the voltage across the zener diode. Therefore, the output of the voltage regulator would vary as $V_{DD}$ varies. If $V_{DD}$ were to increase, the negative supply would tend to decrease in magnitude. As $V_{DD}$ decreases, the negative supply would tend to increase in magnitude.

Other disadvantages reside in the necessity for external capacitors. This means that certain package pins must be dedicated to connecting the external capacitors to the remainder of the integrated circuit.

SUMMARY OF THE INVENTION

It is an object of the present invention to provide an improved regulated negative power supply.

It is a further object of the invention to provide a single chip integrated regulated negative source of supply which requires no external capacitors and therefore no dedicated package pins.

It is a still further object of the present invention to provide an improved regulated negative source of supply which generates an output which is independent of variations in $V_{DD}$.

According to a broad aspect of the invention there is provided an MOS regulated negative power supply, comprising: first means, coupled to an unregulated supply voltage, for generating a positive reference voltage; second means coupled to said first means for converting said reference voltage to a current; third means coupled to said second means for receiving said current and generating therefrom a first voltage; and feedback means coupled to said third means for referencing said first voltage to ground to maintain said first voltage negative and for regulating the negative voltage.

The above and other objects, features and advantages of the present invention will be more clearly understood from the following detailed description taken in conjunction with the accompanying drawings, in which:

DESCRIPTION OF THE PREFERRED EMBODIMENT

Figure 1:
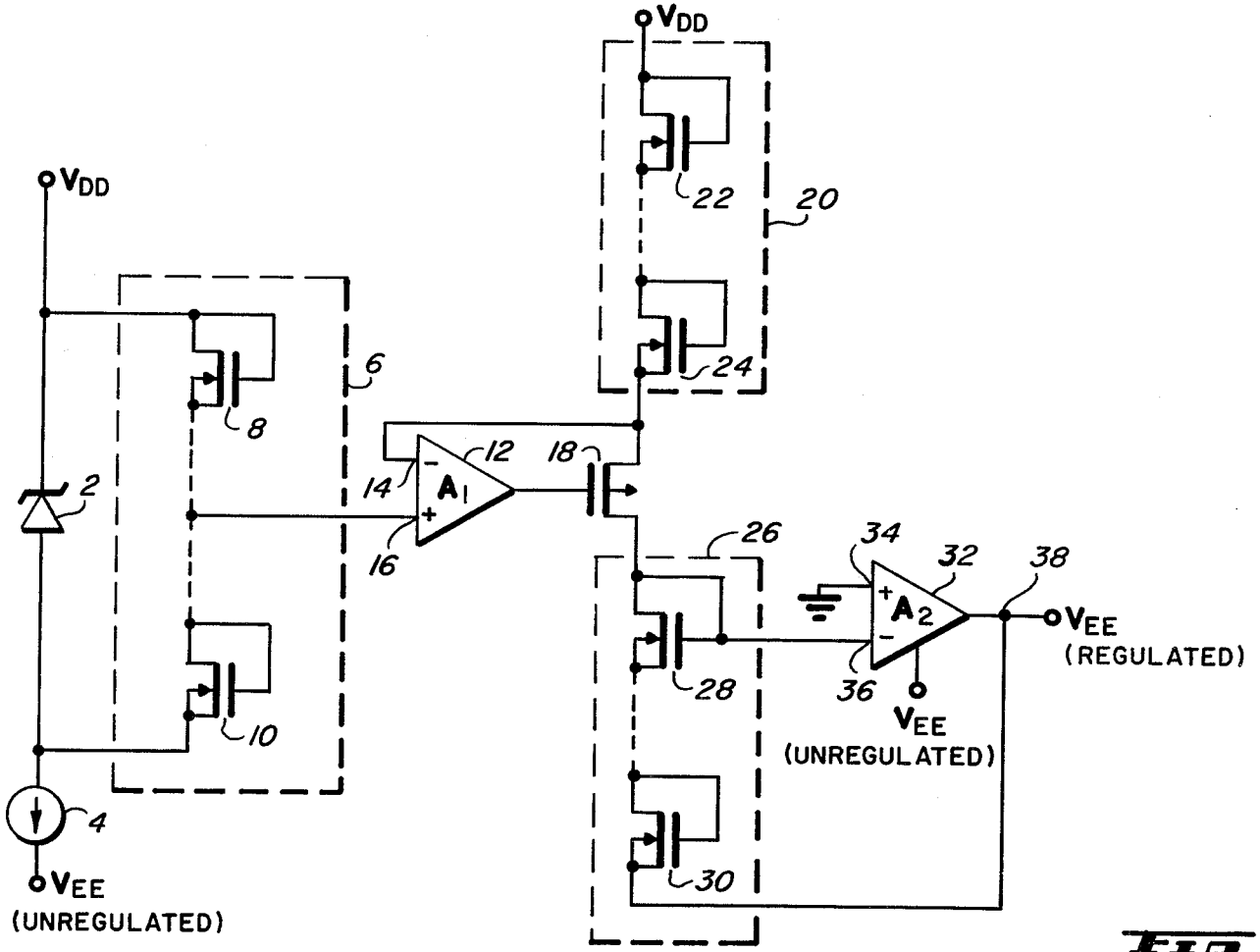
FIG. 1 is a schematic diagram illustrating the general structure and operation of the inventive regulated negative supply.

Referring to FIG. 1, the inventive regulated negative voltage source comprises a zener diode 2 and current source 4 coupled between $V_{DD}$ and unregulated $V_{EE}$, first and second amplifiers 12 and 32, a first device string 6 including, for example, N-channel field-effect transistors (FETs) 8 and 10, a second device string 20 including, for example, N-channel FETs 22 and 24, and a third device string 26 including, for example, N-channel FETs 28 and 30. Zener diode 2 which is operating in the breakdown region causes a voltage of approximately 7 volts to be applied across device string 6, i.e. the drain electrode of device 8 and the source electrode of field effect transistor 10. Both devices are operated as resistors with their gates coupled to their drain electrodes. The source electrode of device 8 is coupled to the drain electrode of device 10 and to the non-inverting input 16 of amplifier 12. By properly scaling devices 8 and 10, a desired fraction of the zener diode breakdown voltage will be applied to the non-inverting input of amplifier 12 since devices 8 and 10 act as a voltage divider. The output of amplifier 12 is coupled to the gate of a P-channel field effect transistor 18 which serves as an output transistor.

The second device string 20 includes series connected N-channel FETs 22 and 24. These devices are connected as resistors; i.e. in each case, the device gate electrode is coupled to its drain electrode. The drain electrode of field effect transistor 22 is also coupled to $V_{DD}$ and the drain electrode of field effect transistor 24 is coupled to the source electrode of field effect transistor 22. The source electrode of device 24 is coupled to both the source electrode of output transistor 18 and to the inverting input of amplifier 12.

Amplifier 12 in conjunction with output transistor 18 and device string 20 acts as a voltage-to-current converter. That is, the configuration causes a voltage to be created across device string 20. This voltage will result in current flow through field effect transistor 18, and the value of this current may be selected by properly selecting the ratio of sizes of devices in device string 6 to those in device string 20.

Each of the devices 28 and 30 in device string 26 has their gate electrode coupled to their drain elecrode. The drain electrode of device 28 is coupled to the drain electrode of output transistor 18, and the source electrode of transistor 28 is coupled to the drain electrode of transistor 30. The gate electrode of transistor 28 is also coupled to the inverting input 36 of amplifier 32. The unregulated $V_{EE}$ is applied to amplifier 32 at 38, and the non-inverting input of amplifier 32 is coupled to ground at 34. The regulated $V_{EE}$ which appears at the output of amplifier 32 is fed back to the source of field effect transistor 30 in device string 26.

This configuration will force the drain and gate electrodes of device 28 to ground. If, the gate electrode of device 28 were to rise to a potential above ground, the output of amplifier 32 would become very negative. This very negative voltage is fed back to the source of device 30 which would tend to bring the voltage appearing at the inverting input of amplifier 32 back down to ground. If on the other hand, the voltage at the inverting input were to fall below ground, the output of amplifier 32 would increase and the feedback would raise the voltage at the inverting input back up to ground.

The current flowing through output transistor 18 is forced to flow through the transistors in device string 26. Since the top of device string 26 is held at ground by amplifier 32, the bottom end of the string (the source of transistor 30) is forced to a negative voltage which is determined by the ratio of the sizes of devices in string 20 to those in string 26.

Two very important things have occurred. First, device 28 looking back into output transistor 18 sees a constant current source. Second, the voltage which appears across diode string 26 is no longer tied to $V_{DD}$ and therefore will not vary with fluctuations in $V_{DD}$.

Figure 2:
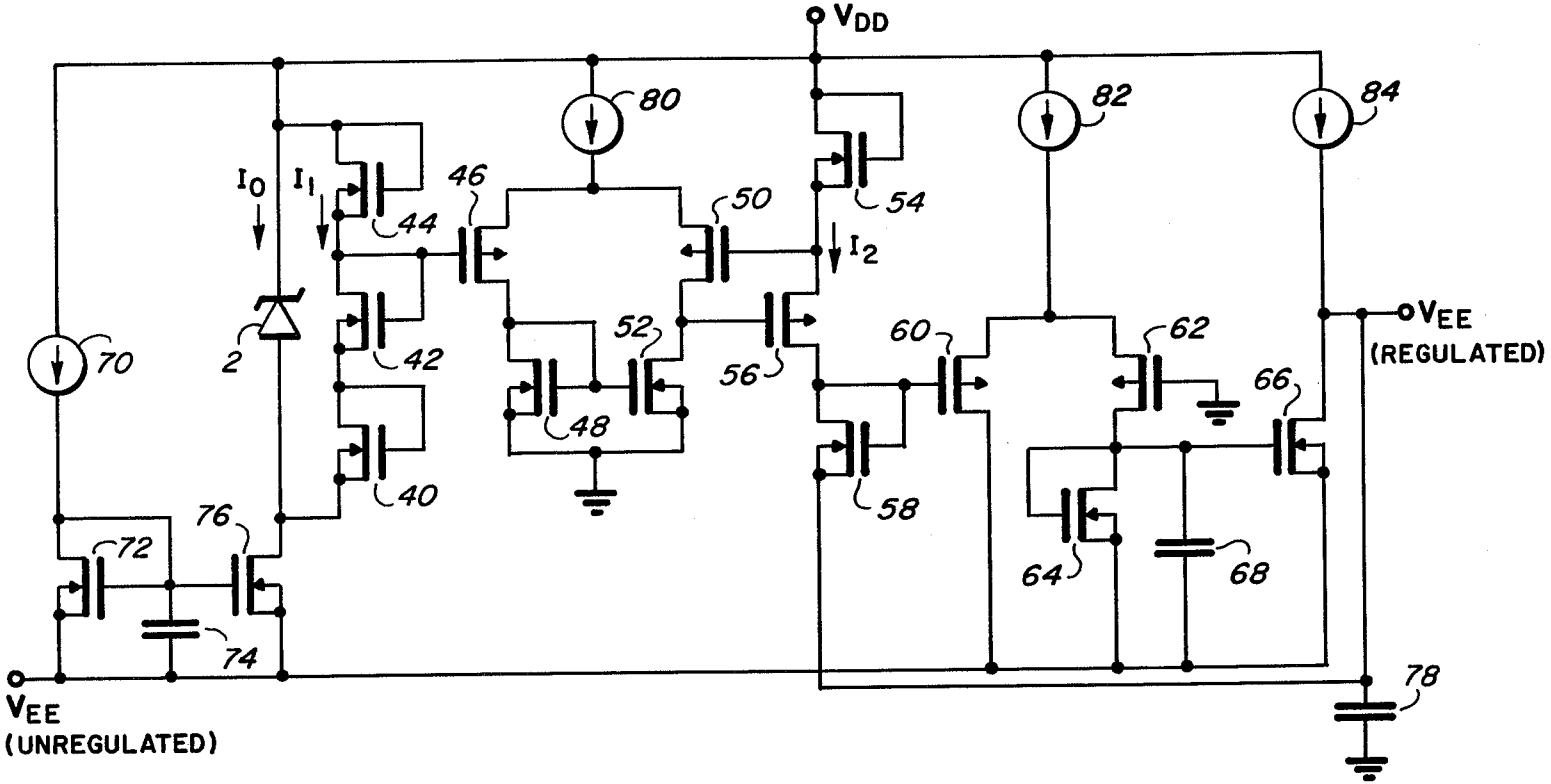
FIG. 2 is a schematic diagram of a specific embodiment of the regulated negative supply shown in FIG. 1.

FIG. 2 is a schematic diagram which illustrates a specific embodiment of the power supply shown in FIG. 1. Device string 6 (FIG. 1) now includes field effect transistors 40, 42 and 44 each device having a gate electrode coupled to its drain electrode. Amplifier 12 in FIG. 1 now comprises field effect transistors 46, 48, 50 and 52. The sources of devices 46 and 50 are coupled together and to $V_{DD}$ via current source 80 which supplies the bias current for the amplifier (typically 10 to 25 microamps). Devices 48 and 52 have their gates coupled together, to the drain electrode of device 46 and to the drain electrode of device 48. The source electrodes of devices 48 and 52 are coupled together and to ground. The drain electrode of transistor 50 is coupled to the drain electrode of transistor 52 and to the gate of output transistor 56. The first input to the amplifier (the gate of device 50) is coupled to the source electrode of transistor 56, and the second input (the gate of transistor 46) is coupled to the current conducting junction of devices 42 and 44. Output transistor 18 in FIG. 1 is output transistor 56 in FIG. 2.

Device strings 20 and 26 in FIG. 1 comprise field effect transistors 54 and 58 respectively in FIG. 2. Each is coupled with its gate electrode tied to its drain electrode. The source electrode of transistor 54 is coupled to the source electrode of output transistor 56 and to the gate electrode of transistor 50.

Operational amplifier 32 (FIG. 1) comprises field effect transistors 60, 62, 64 and 66 in FIG. 2. The source electrode of transistors 60 and 62 are coupled together and to $V_{DD}$ via current source 82 which is typically 5 to 10 microamps. The drain electrode of transistor 60 and the source electrode of transistor 64 are coupled to receive the unregulated $V_{EE}$, and the gate electrode of transistor 64 is coupled to its drain electrode and to the drain electrode of transistor 62. The first input to this amplifier (the gate of transistor 60) is coupled to the current conducting junction of output transistor 56 and transistor 58. The second input (the gate of transistor 62) is coupled to ground. Transistor 66 has a gate electrode coupled to the current conducting junction of devices 62 and 64, has a source electrode coupled to the unregulated $V_{EE}$ and has a drain electrode coupled to $V_{DD}$ via current source 84 which is typically 5 to 10 microamps. The regulated $V_{EE}$ appears at the drain electrode of transistor 66. Capacitor 68 is employed to maintain the gate to source potential of transistor 66 constant, and capacitor 78 merely serves as a filtering capacitor if any noise should appear on the drain electrode of transistor 66.

Field effect transistors 72 and 76 form a current mirror having their gate electrodes coupled together and their source electrodes coupled together and to the unregulated $V_{EE}$ potential. The gate electrode of transistor 72 is connected to its drain electrode. A capacitor 74 is coupled between the common gate electrodes and the unregulated $V_{EE}$ to maintain the voltages on the gates of transistors 72 and 76 equal. The drain of transistor 72 is coupled via current source 70 to $V_{DD}$. The current generated by source 70 need only be sufficient to create sufficient current in transistor 76 to breakdown zener diode 2.

As stated previously, transistors 72 and 76 form a current mirror which causes zener diode 2 to breakdown and provides current to the voltage divider string comprised of transistors 40, 42 and 44. If devices 40, 42 and 44 are identical, a voltage will appear at the gate of transistor 46 which is equivalent to $V_Z/3$ where $V_Z$ is the voltage across zener diode 2. Thus, $V_Z/3$ appears across device 44 and the operational amplifier comprised of transistors 46, 48, 50 and 52 and output transistor 56 and forces a voltage to appear across device 54 which is equivalent to $V_Z/3$ plus the offset voltage of the operational amplifier. The current $I_2$ becomes $$I_2 = K(W/L)_{54}(V_{GS54} - V_{TN})^2 \quad (1)$$

where

K is the product of mobility times the oxide capacitance per unit area divided by 2;

$(W/L)_{54}$ is the ratio of width to length of device 54;

$V_{GS54}$ is the gate to source voltage of transistor 54; and $V_{TN}$ is the threshold voltage of N-channel transistors on the integrated circuit.

Since $$V_{GS54} = V_Z/3 + V_{offset1} \quad (2)$$

then $$I_2 = K(W/L)_{54}(V_Z/3 + V_{offset1} - V_T)^2 \quad (3)$$

where $V_{offset1}$ is the offset voltage of the amplifier including devices 46, 48, 50 and 52.

The gate and drain electrodes of transistor 58 are held at the offset voltage of the operational amplifier comprising transistors 60, 62, 64 and 66. The gate to source voltage of transistor 58 is $$V_{GS58} = \sqrt{\frac{I_2}{K(W/L)_{58}}} + V_{TN} \quad (4)$$

Substituting equation (3) there is obtained $$V_{GS58} = \sqrt{\frac{(W/L)_{54}}{(W/L)_{58}}}\,(V_Z/3 + V_{offset1} - V_{TN}) + V_{TN} \quad (5)$$

The regulated negative supply voltage is $$V_{EE\,reg} = V_{GS58} = V_{offset2} \quad (6)$$

where $V_{offset\,2}$ is the offset voltage produced by the amplifier comprising transistors 60, 62, 64 and 66. Substituting equation (5), there is obtained $$V_{EE\,reg} = V_{offset2} + \sqrt{\frac{(W/L)_{54}}{(W/L)_{58}}} \cdot V_{offset1} + \sqrt{\frac{(W/L)_{54}}{(W/L)_{58}}}\left(\frac{V_Z}{3}\right) + V_{TN}\left(1 - \sqrt{\frac{(W/L)_{54}}{(W/L)_{58}}}\right. \quad (7)$$

Variations in the negative supply output can be minimized in several ways. First, the offset voltages of the amplifiers should be minimized. Second, the quantity $W/L_{54}$ over $W/L_{58}$ should be maintained as close as possible to one in order to eliminate the $V_T$ term. Third, variations in $W/L_{54}$ over $W/L_{58}$ can be minimized by properly sizing and locating the various devices. (Transistors 40, 42, 44, 54 and 58 must be matched.)

In one actual application where $V_Z$ equals approximately 7±0.3 volts, $(W/L_{54})/(W/L_{58})$ equals 1.17, the threshold voltage ($V_T$) is approximately 0.6±0.2 volts and the offset voltages of both amplifiers are ±50 millivolts, the regulated output becomes −2.83±0.26 volts.

The above description is given by way of example only. Changes in form and details may be made by one skilled in the art without departing from the scope of the invention as defined by the appended claims.

We claim:

1. An MOS regulated negative power supply, comprising:

first means, coupled to an unregulated supply voltage, for generating a positive reference voltage;

second means coupled to said first means for converting said reference voltage to a current;

third means coupled to said second means for receiving said current and generating therefrom a first voltage; and feedback means coupled to said third means for referencing said first voltage to ground to maintain said first voltage negative and for regulating the negative voltage.

2. An MOS regulated negative power supply according to claim 1 wherein said second means comprises:

a first operational amplifier having inverting and non-inverting inputs and an output, said non-inverting input coupled to said positive reference voltage;

a first string of series coupled field effect transistors coupled between the source of supply voltage and the inverting input of said amplifier, said amplifier causing a voltage substantially equal to said positive reference voltage to appear across said first string; and an output field effect transistor having source, drain and gate electrodes, said gate electrode coupled to said output, said source electrode coupled to said first string of devices and to said inverting input, and said drain electrode coupled to said third means.

3. An MOS regulated negative power supply according to claim 2 wherein said third means comprises a second string of series coupled field effect transistors each having source, drain and gate electrodes, the gate electrode of a first one of the field effect transistors in said second string being coupled to its drain electrode, the source electrode of said output field effect transistors and to an input of said feedback means, said feedback means having an output which is coupled to said second string, a regulated negative voltage appearing at said output.

4. An MOS regulated negative power supply according to claim 3 wherein said feedback means comprises an operational amplifier reference to said unregulated supply voltage and having inverting and non-inverting inputs and an output, said non-inverting input coupled to ground, said inverting input coupled to the gate electrode of the first field effect transistor in said second string said output for producing a regulated negative supply voltage which is feedback to said second string.

5. An MOS regulated negative power supply according to claim 4 wherein said first means comprises a zener diode for operation in the breakdown mode; and a third string of series coupled field effect transistors coupled across said zener diode, each field effect transistor having source, drain and gate electrodes, the gate electrode of each of said transistors coupled to its drain electrode.

6. An MOS regulated negative power supply according to claim 5 wherein said third string comprises first, second and third series coupled field effect transistors, said first field effect transistor having a drain coupled to the cathode of said zener diode, said third transistor having a source coupled to the anode of said zener diode and said reference voltage appearing at the source electrode of said first field effect transistor.

7. An MOS regulated negative power supply according to claim 6 wherein said first string comprises a single field effect transistor having its gate and drain terminals coupled together and having a source terminal coupled to the inverting input of said first amplifier and to the source electrode of said output transistor.

8. An MOS regulated negative power supply according to claim 7 wherein said second device string comprises a single field effect transistor having its gate and drain electrodes coupled together and to the drain electrode of said output transistor and to the inverting input of said second amplifier and having a source electrode coupled to the output of said second amplifier.

9. An MOS regulated negative power supply according to claim 8 wherein said fourth and fifth field effect transistors are matched.

10. An MOS regulated negative power supply according to claim 9 wherein said first, second, third, fourth and fifth field effect transistors are matched.

* * * * *